US007381013B1

(12) United States Patent
Rataj et al.

(10) Patent No.: US 7,381,013 B1
(45) Date of Patent: Jun. 3, 2008

(54) ROCK BOLT POST GROUTING APPARATUS

(75) Inventors: Mieczyslaw Stanislaw Rataj, Charlestown (AU); Otmar Langwadt, Markt Schwaben (DE)

(73) Assignee: DYWIDAG-Systems InternationalPty Limited, Bennett's Green, New South Wales (AU)

( * ) Notice: Subject to any disclaimer, the term of this patent is extended or adjusted under 35 U.S.C. 154(b) by 228 days.

(21) Appl. No.: 10/523,355

(22) PCT Filed: Aug. 1, 2003

(86) PCT No.: PCT/AU03/00967

§ 371 (c)(1),
(2), (4) Date: Jan. 17, 2006

(87) PCT Pub. No.: WO2004/013463

PCT Pub. Date: Feb. 12, 2004

(30) Foreign Application Priority Data

Aug. 2, 2002 (AU) ..... 2002950558
Dec. 24, 2002 (AU) ..... 2002953569

(51) Int. Cl.
*E21D 20/00* (2006.01)

(52) U.S. Cl. ..... 405/259.5; 405/259.3

(58) Field of Classification Search ..... 405/259.1, 405/259.3, 259.5, 259.6
See application file for complete search history.

(56) References Cited

U.S. PATENT DOCUMENTS 3,665,717 A * 5/1972 Sweeney et al. ..... 405/259.5
3,971,177 A * 7/1976 Endo ..... 405/259.5
4,732,510 A * 3/1988 Louis ..... 405/259.5
4,832,534 A * 5/1989 Duvieusart ..... 405/259.6
5,007,780 A * 4/1991 Hoffmann et al. ..... 405/259.5

(Continued)

FOREIGN PATENT DOCUMENTS

AU 20201/95 11/1995

(Continued)

OTHER PUBLICATIONS

International Search Report, International Application No. PCT/AU03/00967, mailed Aug. 29, 2003.

(Continued)

*Primary Examiner*—Frederick L Lagman
(74) *Attorney, Agent, or Firm*—Marshall, Gerstein & Borun LLP

(57) ABSTRACT

An apparatus (100) for post-grouting a rock bolt (1) has an elongate sleeve (101) adapted to receive a rock bolt (1) with a first end (1*a*) thereof extending beyond the sleeve first end (101*a*) and a second end (1*b*) thereof extending beyond the sleeve second end (101*b*). An end fitting (102) is attached to the sleeve second end (101*b*) and has a central aperture (106, 107) for receiving the rock bolt (1). Grout passages (112) communicate the exterior of the end fitting (102) with the interior of the sleeve (101). A seal means (117) is displaceable between open and closed positions so as to seal the grout passages (112). The seal means (117) is biased towards the closed position at which the grout passages (112) are substantially sealed. Injection of grout into the end fitting (102) via the passages (112) deflects the seal means (117) to the open position enabling flow of grout through the passages (112) and into the sleeve (101).

23 Claims, 8 Drawing Sheets

U.S. PATENT DOCUMENTS

| | | | | |
|---|---|---|---|---|
| 5,375,947 | A * | 12/1994 | Gouws et al. | 405/259.5 |
| 5,622,454 | A * | 4/1997 | Ashmore et al. | 405/259.5 |
| 5,636,945 | A * | 6/1997 | Nes | 405/259.1 |
| 7,037,046 | B2 * | 5/2006 | Fergusson | 405/259.5 |
| 2004/0136789 | A1 * | 7/2004 | Fergusson | 405/259.5 |

FOREIGN PATENT DOCUMENTS

| | | |
|---|---|---|
| AU | 200055048 | 3/2001 |
| DE | 27 32 059 | 2/1979 |

OTHER PUBLICATIONS

"Zulassungsbescheid" issued by the Institut für Bautechnik on Jun. 28, 1983.

* cited by examiner

ROCK BOLT POST GROUTING APPARATUS

TECHNICAL FIELD

The present invention relates to improvements in rock reinforcement installations, and in particular relates to an apparatus for post-grouting of rock bolt installations to improve load transfer between the rock and the bolt and to provide corrosion protection.

BACKGROUND OF THE INVENTION

The roof of an underground mine is secured using rock bolts to confine the rock. The rock bolts are inserted into a hole, predrilled into the rock.

Usually, the rock bolt is secured at the top of the hole by a mechanical or chemical anchor creating a point anchor. Alternatively, or additionally, the rock bolt is secured in the hole by grouting along its length with a cement or polyester resin.

Grouting of the bolt along its entire length is the much preferred method to improve confinement of the rock through load transfer between the rock and bolt along its entire length rather than at a local area only. Grouting of the bolt also protects it from corrosion.

In rock bolt installations where it is feasible to drill a relatively small diameter hole (up to 32 mm diameter) in the rock face, it is preferred to use chemical anchors at the top of the hole which extrude the resin grout along the length of the bolt so as to effectively fully grout the bolt.

In installations where larger diameter holes (typically 45 mm diameter) need to be drilled, resin cartridge chemical anchors are relatively ineffective as the large annulus between the conventional solid bolt (typically 22 mm diameter) and the hole wall is too large to enable effective mixing of the resin. In such cases, the bolts are typically post-grouted with a cement grout to fully encapsulate the rock bolts.

Australian Patent Application No. 49856/93 discloses a method of post-grouting a rock bolt which utilises a plastic sleeve mounted on the bolt and which extends along substantially the entire length of the bolt (approximately 2 m long) toward the top of the hole. The sleeve communicates with a grouting chamber located at the base of the bolt below the roof plate. Grout is pumped into the grouting chamber, using a grout nozzle pushed into a hole provided in the grouting chamber. The grout flows upwardly through the inner annular passage defined between the sleeve and rock bolt to the end of the sleeve at the top of the hole and then spreads down the outer annular passage between the sleeve and the wall of the rock bolt hole. The plastic sleeve accordingly divides the grout into two annular columns, which provides additional corrosion protection to the rock bolt. A tensioning nut is threaded onto the exposed end of the bolt and engages the body of the grouting chamber which in turn engages a roof plate bearing against the rock face surrounding the rock bolt hole.

The above method, however, suffers from several disadvantages. Firstly, when the rock bolt is installed into a roof covered with a wire mesh, the leading end of the plastic sleeve often catches on the wire, obstructing the installation. Secondly, once the grouting nozzle is detached from the grouting chamber, grout drains from the grouting chamber under gravity through the hole into which the grouting nozzle had been inserted, thereby reducing the level of grout encapsulation of the bolt. Thirdly, whilst the grout encapsulates the rock bolt within the rock bolt hole, the tail end of the rock bolt and the nut used to pre-tension the rock bolt remain exposed and subject to corrosion. Further, if the rock face is uneven, the roof plate will often not be perpendicular to the hole and the rock bolt when pressed against the rock face by tensioning of the nut. This causes the grouting chamber body, moving with the roof plate as a result of friction, to be misaligned with the nut. Accordingly, the nut and grouting chamber body do not engage with parallel faces and the ability to tension the rock bolt with the nut is thereby reduced.

OBJECT OF THE INVENTION

It is an object of the present invention to overcome or substantially ameliorate at least one of the above disadvantages.

SUMMARY OF THE INVENTION

There is disclosed herein an apparatus for post-grouting a rock bolt comprising:

an elongate sleeve having first and second ends and being adapted to receive a rock bolt with a first end thereof extending beyond said sleeve first end and a second end thereof extending beyond said sleeve second end;

an end fitting attached to said sleeve second end, said end fitting having a central aperture for receiving said rock bolt and one or more grout passages communicating the exterior of said end fitting with the interior of said sleeve; and seal means for sealing said one or more said grout passages, said seal means being displaceable between open and closed positions;

wherein said seal means is biased towards said closed position at which said one or more passages is/are substantially sealed and injection of grout into said end fitting via said passage(s) deflects said seal means to said open position enabling flow of grout through said one or more passages and into said sleeve.

In one form, said end fitting comprises:

a female component secured to said sleeve second end and defining a concavity facing away from said sleeve, and a male component adapted to be threaded onto said rock bolt second end and to be received within said female component concavity so as to transfer compressive loads between said male and female components, wherein said one or more grout passages is/are defined between said male and female component is provided with a nut drive surface for threading said male component onto said rock bolt second end to tension said rock bolt.

Typically, said female component concavity is semi-spherical and said male component is provided with a generally complementary convex semi-spherical peripheral surface.

Typically, said female component is provided with coupling means on a peripheral surface thereof for coupling to a grout delivery hose coupling.

Preferably, a plurality of said passages are defined as recesses in the peripheral surface of said male component.

Preferably, said seal means comprises a flap associated with each of said one or more grout passages.

Preferably, said flap(s) is/are formed of a resilient plastics material.

Said seal means may comprise a ring-like member extending about said male component with said flap(s) being integrally formed with said ring-like member.

Said apparatus may include a plastic cap at least substantially covering said end fitting male component.

In one form, said plastic cap incorporates said seal means.

Preferably, a peripheral edge of said cap is adapted to engage a groove provided in said end fitting female component concavity to thereby retain the assembly of said plastic cap, said end fitting male component and said end fitting female component.

Preferably, said apparatus is provided with a tapered cap at said sleeve first end, said tapered cap being provided with a central open passage for receipt of said rock bolt and a plurality of apertures in a side wall of said cap for passage of grout therethrough.

The female component may desirably be formed of stainless steel.

There is further disclosed herein an apparatus for post-grouting a rock bolt comprising:

an elongate sleeve having first and second ends and being adapted to receive a rock bolt with a first end thereof extending beyond said sleeve first end and a second end thereof extending beyond said sleeve second end;

an end fitting attached to said sleeve second end, said end fitting having a central aperture for receiving said rock bolt and one or more grout passages communicating the exterior of said end fitting with the interior of said sleeve;

a coupling member having first and second ends and an internal cavity opening onto said coupling member first end, said coupling member first end being adapted to be coupled to said end fitting with said coupling member cavity communicating with said one or more grout passages, said coupling member being provided with an inlet port adapted to be coupled to a grout delivery hose and a valve means for sealing said inlet port, wherein said coupling member is adapted to enclose said rock bolt second end within said coupling member cavity.

Preferably, said coupling member is formed of a plastics material.

There is still further disclosed herein an apparatus for post-grouting a rock bolt comprising:

an elongate sleeve having first and second ends and being adapted to receive a rock bolt with a first end thereof extending beyond said sleeve first end and a second end thereof extending beyond said sleeve second end; and an end fitting attached to said sleeve second end and having a central aperture for receiving said rock bolt, said end fitting comprising:

a female component secured to said sleeve second end and defining a concavity facing away from said sleeve, and a male component adapted to be threaded onto said rock bolt second end and to be received within said female component concavity and engage the wall thereof, wherein one or more grout passages communicating the exterior of said end fitting with the interior of said sleeve are defined at the interface between said male and female components and said male component is provided with a nut drive surface for threading said male component onto said rock bolt second end to tension said rock bolt, further wherein a plastic cap at least substantially covers said end fitting male component, a peripheral edge of said cap being adapted to engage a groove provided in said end fitting female component concavity to thereby retain the assembly of said plastic cap, said end fitting male component and said end fitting female component.

In one form, the plastic cap incorporates a seal means for sealing said one or more grout passages, said seal means being displaceable between open and closed positions and being biased towards said closed position at which said one or more passages is/are substantially sealed and injection of grout into said end fitting via said passage(s) deflects said seal means to said open position enabling flow of grout through said one or more passages and into said sleeve.

In one form, said male component has a blind threaded aperture for threadingly receiving said rock bolt second end.

In an alternate form, said male component has a threaded aperture extending through the length thereof for threadingly receiving said rock bolt second end, said threaded aperture and/or said rock bolt being configured to prevent said rock bolt second end extending beyond said threaded aperture.

Rock bolt assemblies comprising each of the apparatuses disclosed above in combination with a rock bolt are also disclosed.

BRIEF DESCRIPTION OF THE DRAWINGS

Preferred forms of the present invention will now be described by way of examples with reference to the accompanying drawings, wherein.

DETAILED DESCRIPTION OF THE PREFERRED EMBODIMENTS

Figure 1:
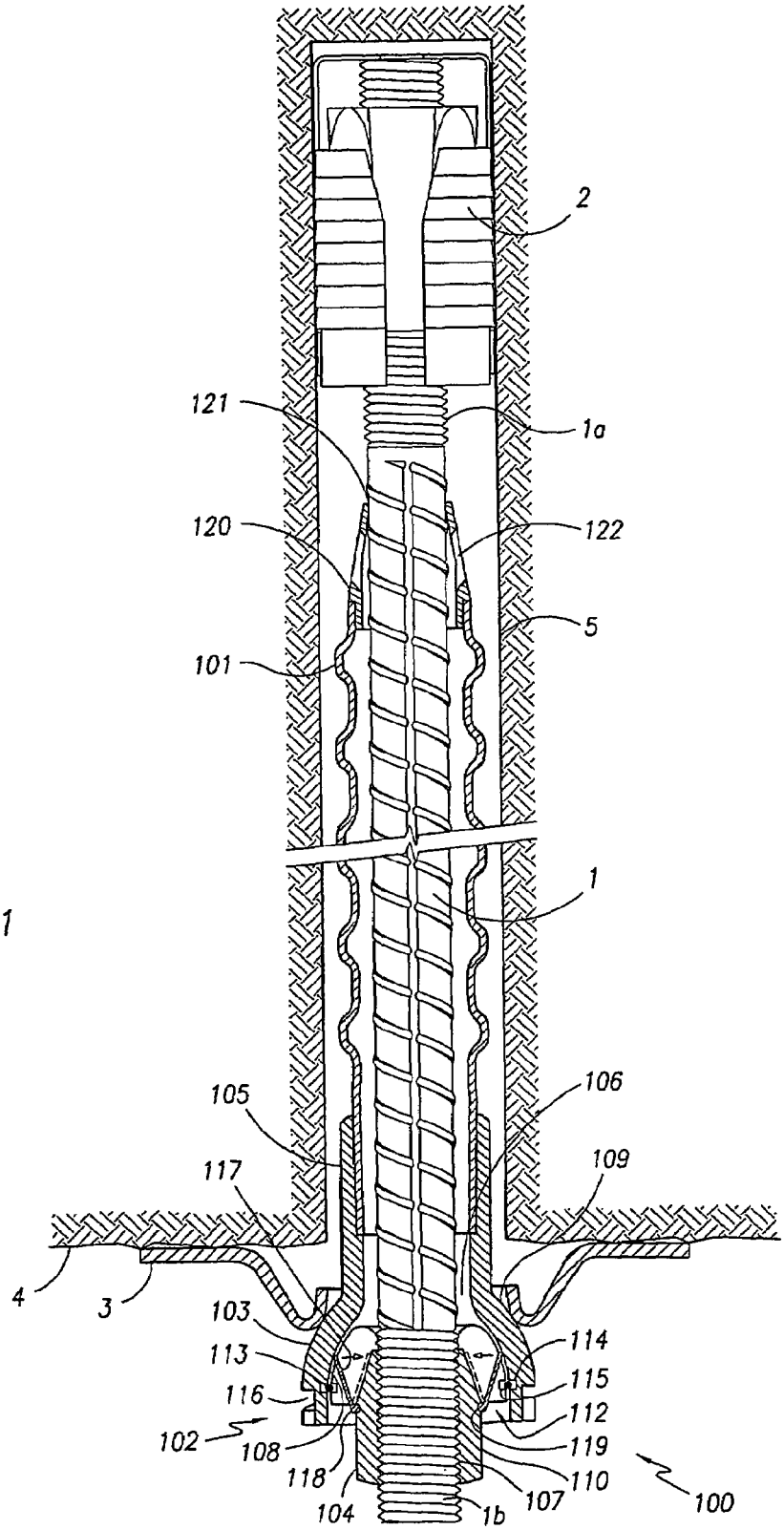
FIG. 1 is a cross sectional side elevation view of a rock bolt installation.
Figure 2:
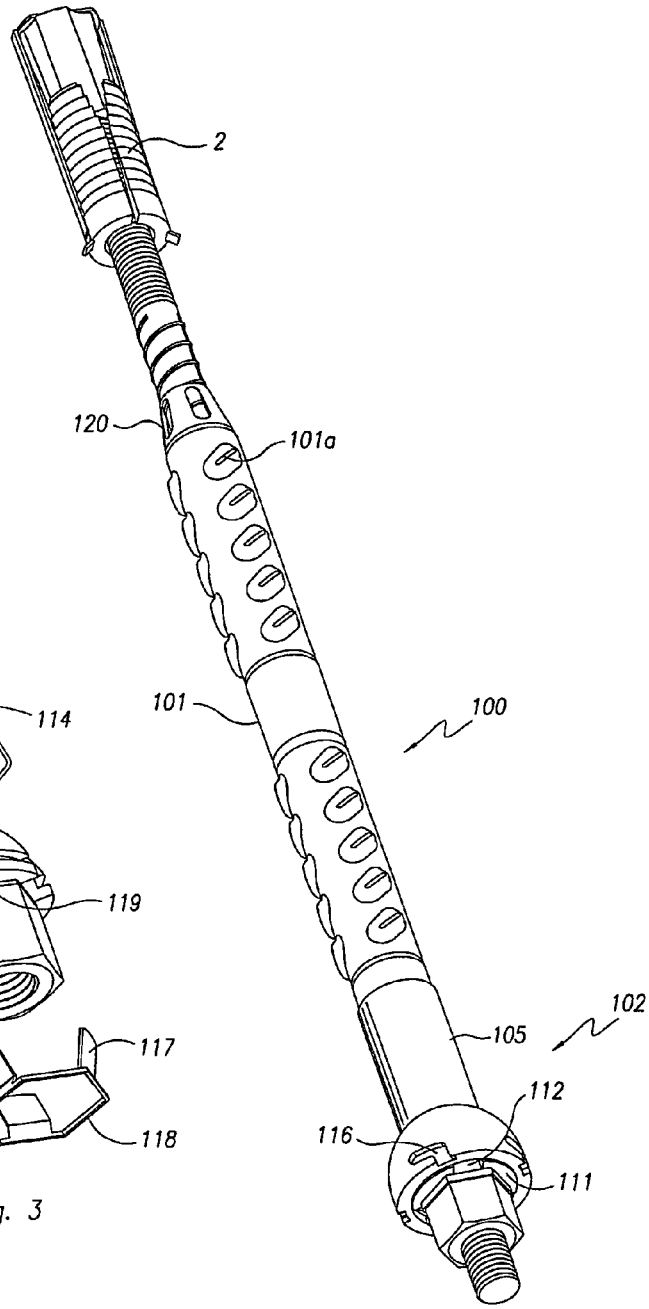
FIG. 2 is a perspective view of the rock bolt assembly of the installation of FIG. 1.

Referring to FIGS. 1 and 2 of the accompanying drawings, a rock bolt assembly consists of a standard rock bolt 1 having threaded first and second ends 1*a*, 1*b*, a standard expansion shell type mechanical anchor 2 threaded onto the rock bolt first end 1*a* and a rock bolt post-grouting apparatus 100. The post-grouting apparatus 100 has an elongate sleeve 101 and an end fitting 102. The elongate sleeve 101 is configured to is receive the rock bolt 1 with the rock bolt first end 1*a* extending beyond the sleeve first end 101*a* and the rock bolt second end 1*b* extending beyond the sleeve second end 101*b*. The sleeve 101 will typically have a length such that it extends from adjacent the expansion shell 2 at the rock bolt first end 1*a* to adjacent the threaded second end 1*b* of the rock bolt, being a length typically of the order of 2 m. The sleeve 101 will typically be formed of a plastics material and is provided with corrugations 101*a* which assist in anchoring the sleeve 101 with respect to the grout.

The end fitting 102 is here in the form of a female component 103 and a male component 104, as depicted in greater detail in FIGS. 3 to 6. The female component 103 is attached to the sleeve second end 101*b* by way of an annular flange 105. The rock bolt second end 1*b* extends through the end fitting 102 via apertures 106, 107 provided in the female and male components 103, 104. The female component 103 is in the general form of a cup, having a semi-spherical concavity 108 facing away from the sleeve 101. The end fitting female component 103 has a partly spherical outer surface 109 which engages a roof plate 3 which bears against the rock face 4 surrounding the rock bolt hole 5 in the usual manner.

The male component 104 is in the form of a modified nut having a nut drive surface 110 and with the central aperture 107 being threaded for engagement with the threads of the rock bolt second end 1*b*. The leading end of the nut 104 is provided with three radial protrusions 111 each having a convex semi-spherical surface generally complementary to the concavity 108 of the female cup 103. When the nut 104 is threaded onto the rock bolt second end 1*b* such that the radial protrusions 111 bear against the concavity of the cup 103, grout passages 112 are defined at the interface between the nut 104 and cup 103 in the spaces between the radial protrusions 111. These grout passages 112 communicate the exterior of the end fitting 102 with the interior of the sleeve 101, thereby providing a passage for the injection of grout into the sleeve 101.

The nut 104 is retained in position with the protrusions 111 abutting the wall of the concavity 108 of the cup 103 by way of a retaining clip 113 engaging grooves 114, 115 provided respectively in the wall of the cup concavity 108 and the nut protrusions 111, as best depicted in FIG. 1. This retention is purely for handling and transport purposes, as in use the nut 104 secures the cup 102 against the roof plate 3.

With the interface between the nut protrusions 111 and the wall of the cup concavity 108 being semi-spherical, any misalignment of the cup 103 resulting from misalignment of the roof plate when the rock face is uneven, will have no adverse effect. When the cup is misaligned fall contact is still provided between the nut 104 and cup 103 in the same manner as a ball and socket joint.

The relationship between the nut protrusions 111 and the wall of the cup concavity 108 provide for transfer of compressive loads from the nut 104 to the cup 102, which are in turn transferred to the rock face by way of the roof plate 3. These compressive loads are developed in reaction to the tensile loads in the bolt 1 resulting from tensioning of the bolt 1 by way of the nut 104.

Figure 8:
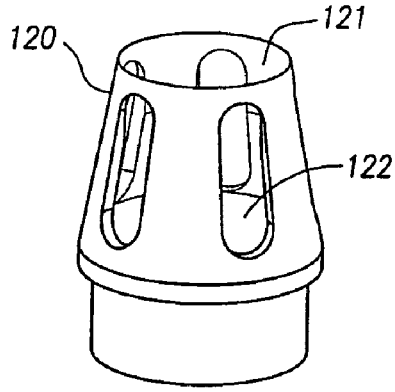
FIG. 8 is a perspective view of the sleeve cap of the post-grouting apparatus of the assembly of FIG. 2.

The outer part spherical surface 109 of the cup 103 is provided with coupling means, in the form of slots 116, for engagement with corresponding pins 6 provided in a standard grout delivery hose coupling 7 as depicted in FIG. 8.

As an alternative, the end fitting could be a single component with grout passages extending therethrough, with a separate nut being provided to bear against the end fitting when tensioning the bolt. Such a configuration would, however, suffer from the potential misalignment problem discussed above if the rock face is uneven.

Figure 3:
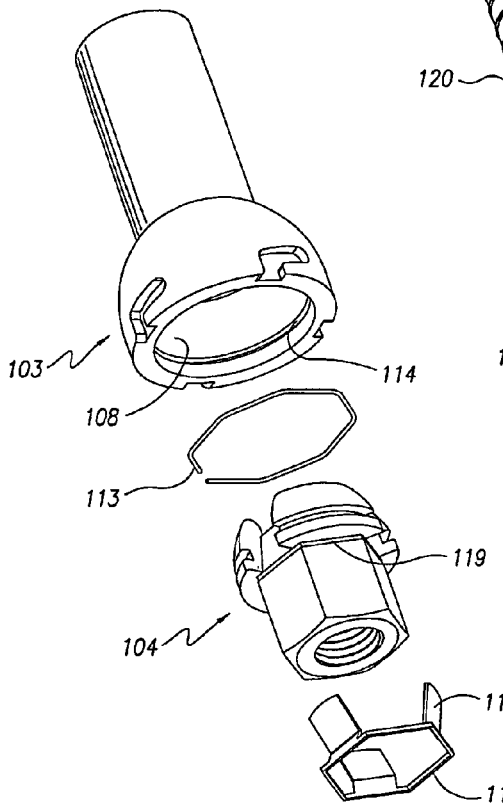
FIG. 3 is an exploded view of the end fitting of the post-grouting apparatus of the assembly of FIG. 2.
Figure 4:
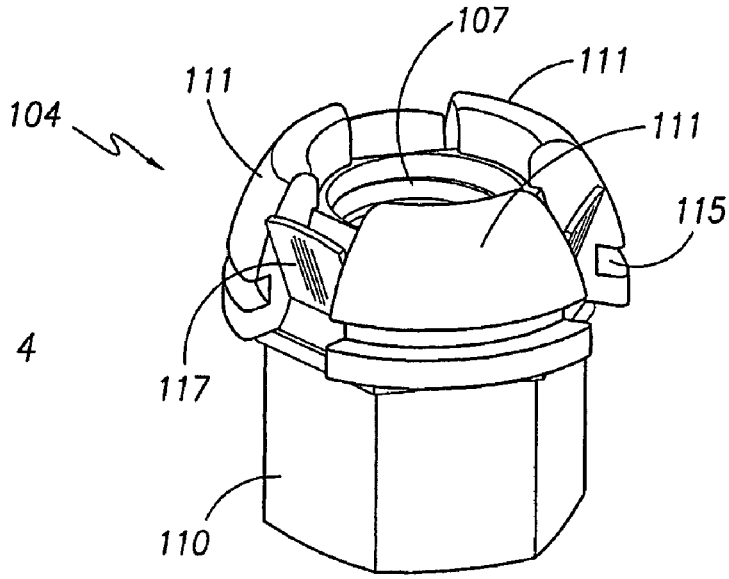
FIG. 4 is a perspective view of the male component of the end fitting of FIG. 3.
Figure 5:
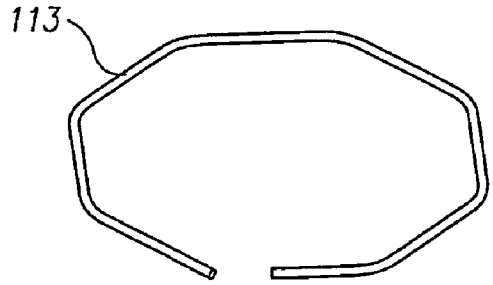
FIG. 5 is a perspective view of the retainer clip of the end fitting of FIG. 3.
Figure 6:
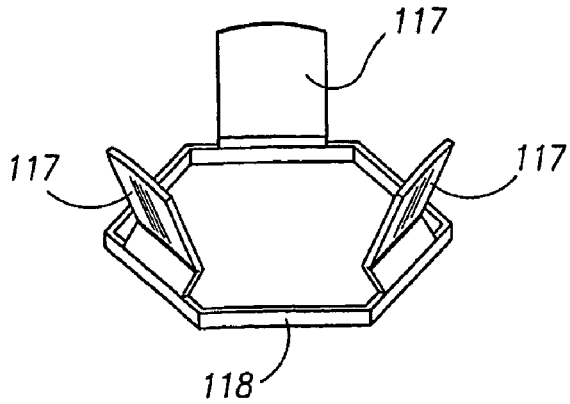
FIG. 6 is a perspective view of the seal means of the end fitting of FIG. 3.
Figure 7:
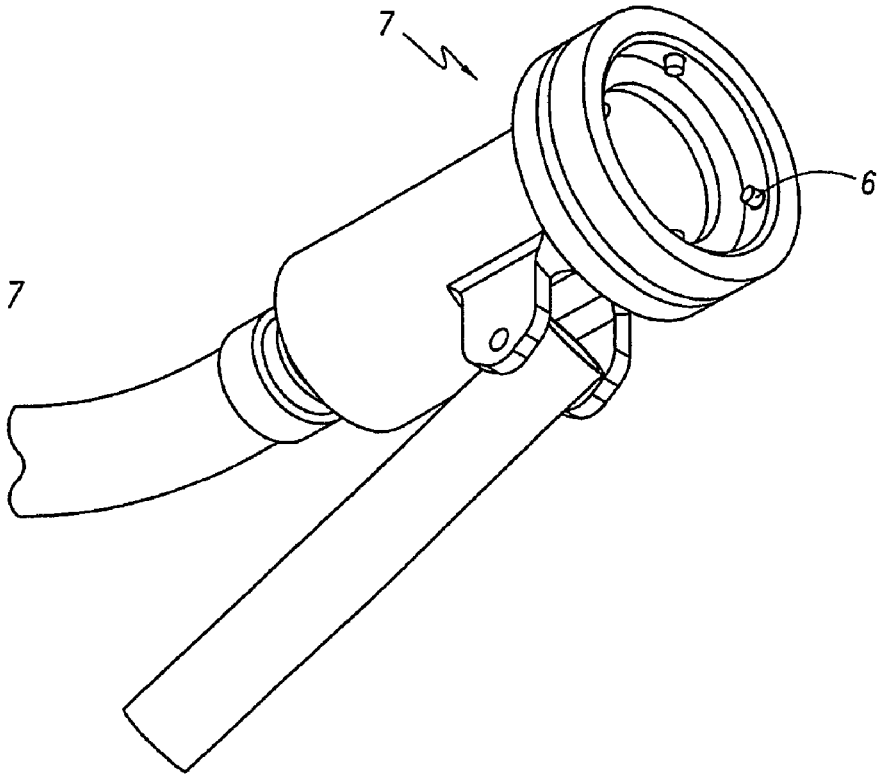
FIG. 7 is a perspective view of a grout delivery hose coupling.

Seal means, here in the form of flaps 117, depicted in greater detail in FIGS. 3, 4 and 6, are provided for sealing the grout passages 112. As depicted in FIG. 1, the flaps 117 are displaceable between open and closed positions, with the flaps being biased towards the closed position (depicted in solid cross section). At the closed position the passages 112 are substantially sealed to prevent the flow of grout down through the passages 112 and out of the end fitting 102. When grout is injected into the end fitting 102 via the grout passages 112, the flow deflects the flaps 117 to the open position (depicted in phantom) enabling the flow of grout through the passages 112 and into the sleeve 101. When the injection of grout ceases, the biasing action of the flaps 117 moves them to the closed position, with the weight of the grout above the flaps 117 also tending to force the flaps 117 to the closed position.

As best depicted in FIG. 6, the flaps 117 are integrally formed with a ring-like member 118. The ring-like member 118 is mounted in a groove 119 provided around the periphery of the nut 104 directly beneath the radial protrusions 111, as best depicted in to FIG. 1. The ring-like member 118 and flaps 117 are moulded from a resilient plastics material, with the resilience of the plastics material providing the biasing force tending to close the flaps 117. The flaps 117 might alternatively be spring biased utilising a separate spring mechanism, however the simple plastic moulding avoids the difficulties which might be associated with clogging of any spring mechanisms with grout.

Figure 9:
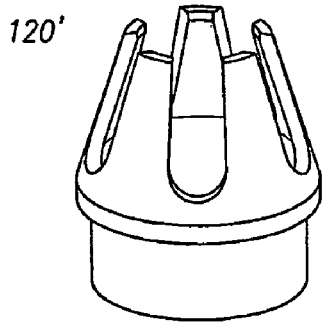
FIG. 9 is a perspective view of an alternate sleeve cap.

The first end 101*a* of the sleeve is provided with a tapered cap 120, depicted in further detail in FIG. 8. The tapered cap 120 has a central open passage 121 through which the rock bolt 1 passes and a plurality of apertures 122 in the cap side wall to enable passage of grout therethrough. Whilst the cap of FIG. 8 has the apertures 122 spaced from the tapered end of the cap, it is envisaged that the apertures might extend to the tapered end as depicted in the variant of the cap 120' depicted in FIG. 9. The tapered cap 120, 120' assists in preventing the sleeve 101 from fouling on wire mesh placed over the rock face or on the edge of the rock bolt hole 5 itself during installation.

A rock bolt assembly will typically be provided with the expansion shell 2 and post-grouting apparatus 100 already assembled onto the rock bolt 1. During installation, the rock bolt assembly is installed into the rock bolt hole with a roof plate 3 in place on the rock face 4. The expansion shell 2 is then expanded by rotating the rock bolt 1 via the nut drive surface 110 of the nut 104 in the usual manner, and the bolt tensioned by further tightening of the nut 104. During tightening of the nut 104, the nut bears against the cup 102 which in-turn bears against the roof plate 3, transferring compressive loads to the rock face 4.

A grout delivery hose is then attached to the end fitting 102 by way of the hose coupling 7, and grout injected into the grout passages 112, deflecting the seal flaps 117 to the open position. The grout flows through the passages 112 and up through the interior annular passage defined between the sleeve 101 and the rock bolt 1, through the apertures 122 in the tapered cap 120 and down through the outer annular passage between the sleeve 101 and the wall of the rock bolt hole 5. When the delivery of grout is ceased, the resiliency of the plastic seal flaps 117, along with the weight of the grout, forces the seal flaps 117 to the closed position, preventing grout from escaping from the inner annular passage between the sleeve 101 and the rock bolt 1. Full encapsulation of the rock bolt 1 can accordingly be retained. The coupling 7 is then disengaged from the end fitting 102 to complete the installation process.

Figure 10:
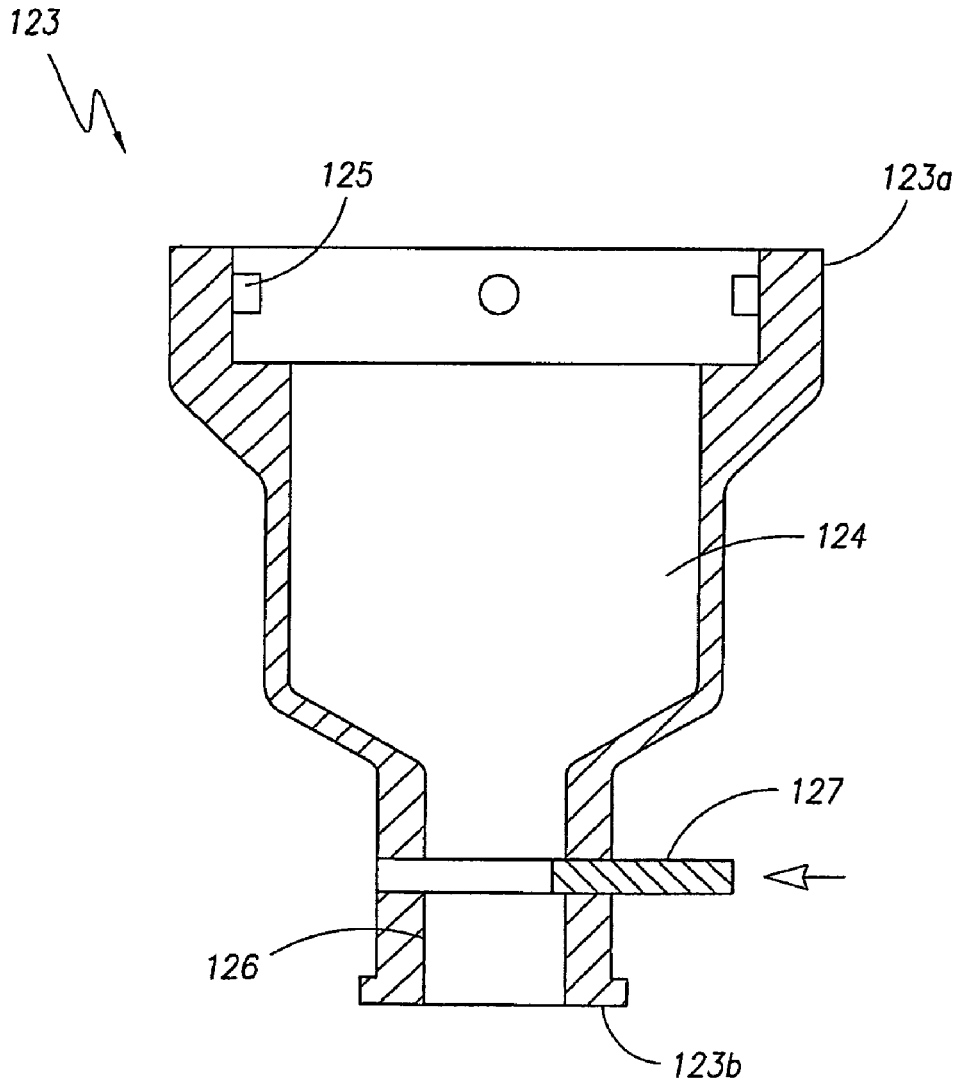
FIG. 10 is a cross sectional side elevation view of a coupling member.

Whilst the rock bolt remains substantially fully encapsulated with grout within the hole, to thereby protect it against corrosion as well as providing for load transfer between the rock bolt 1 and surrounding rock, the nut 104 and rock bolt second end 1*b* remain exposed, and therefore subject to corrosion. To enable protection of the nut 104 and rock bolt second end 1*b* against corrosion, a coupling member 123, as depicted in FIG. 10, can be utilised. The coupling member 123 has an internal cavity 124 opening onto the first end 123*a* of the coupling member. Pins 125 are provided in the first end 123*a* of the coupling member to enable the coupling member 123 to be coupled to the end fitting 102 described above in the same manner as the hose coupling 7 of FIG. 8. The coupling member 123 also has an inlet port 126, here positioned at the coupling member second end 123*b*, which can be directly coupled to a grout delivery hose by any suitable means. A valve means, here in the form of a gate valve 127 is provided to seal the inlet port. The coupling member 123 is sized such that it encloses the rock bolt second end 1*b*, and the portion of the nut 104 protruding beyond the cup 102, within the cavity 124 of the coupling member 123.

During installation, the coupling member 123 will be secured to the end fitting 102 in the same manner as described above, with a grout delivery hose being coupled to the inlet port 126. Grout is injected through the coupling member 123 and into the grout passages 112 in the same manner as discussed above. Once the delivery of grout has been ceased, however, the valve 127 is closed and the coupling member 123 is left in situ coupled to the cup 102, with the grout delivery hose being removed from the inlet port 126. Accordingly, the coupling member 123 remains filled with grout, fully encasing the rock bolt second end 1*b* and nut 104, protecting the same from corrosion. As the valve 127 will prevent the escape of grout from the assembly, it is envisaged that the seal flaps 117 might be omitted from the grout delivery apparatus when such a coupling member 123 is used, however it is preferred that the seal flaps remain to provide an added safeguard from the possible escape of grout from the sleeve 101. As the coupling member 123 remains in situ, and accordingly one coupling member 123 is required for each rock bolt, it is preferred that the coupling member be moulded from plastics material so as to reduce costs.

Figure 11:
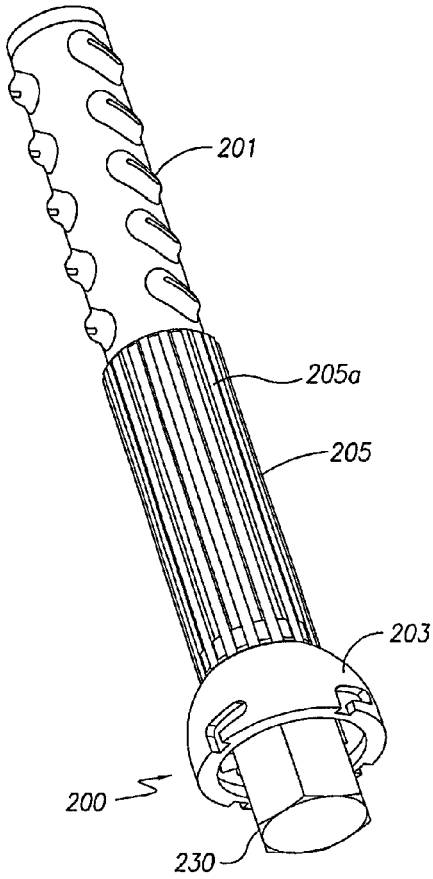
FIG. 11 is a perspective view of the end fitting and sleeve of an alternate post-grouting apparatus.
Figure 12:
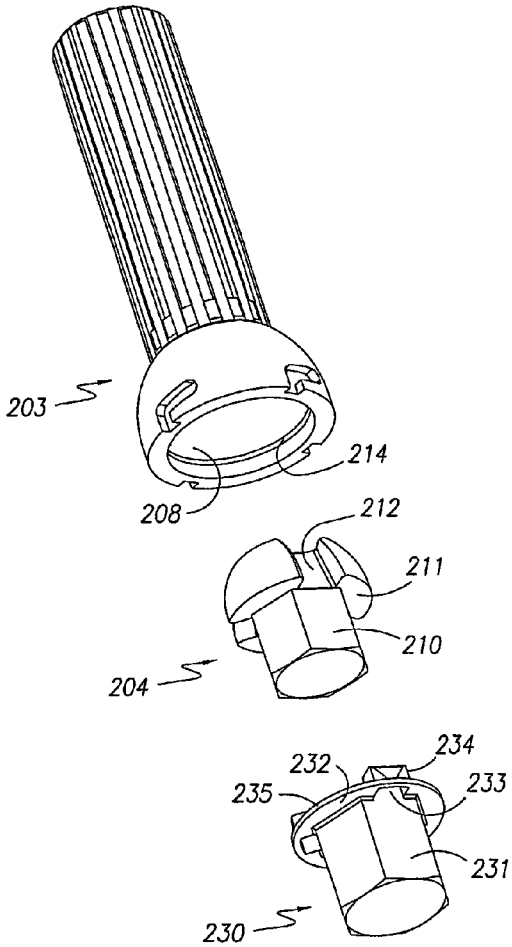
FIG. 12 is an exploded view of the end fitting of FIG. 11.

Referring to FIGS. 11 and 12, an alternate post-grouting apparatus 200 is depicted. This alternate post-grouting apparatus has an elongate sleeve 201 as per that of FIGS. 1 and 2 and an end fitting 202 in the form of a female cup-like component 203 and a male nut-like component 204 similar to that of FIGS. 1 to 4.

A plastic cap 230 substantially covers the nut 204. The cap 230 consists of a nut covering portion 231 which covers the nut drive surface 210 of the nut 204 and an annular flange 232 which covers the nut protrusions 211. Apertures 233 are formed in the flange portion 232 enabling access to the grout passages 212 defined in the spaces between the nut protrusions 211. Walls 234 extend from the flange apertures 233 so as to cover the side walls of the grout passages 212. The peripheral edge 235 of the cap annular flange 232 engages a groove 214 provided in the wall of the concavity 208 of the cup 203. This engagement retains the assembly of the cap 230, nut 204 and cup 203 during transport and handling of the rock bolt assembly.

The plastic cap 230 acts to protect the nut 204 of the end fitting 202 against corrosion. As the cap 230 can be installed during initial assembly of the rock bolt assembly prior to installation to a rock bolt hole, the access difficulties associated with fitting of the coupling member 123 of FIG. 10 to an already installed rock bolt assembly in the high roof of a mine are eliminated.

The side walls of the nut covering portion 231 of the plastic cap 230 are approximately 2 mm thick, whilst the end wall is approximately 4 mm thick, with this thicker wall being suitable to bear the driving load applied by the installation rig during rock bolt installation without tearing of the cap 230. To cater for the wall thicknesses of the cap nut covering portion 231, the nut drive portion 210 of the nut is of a reduced size as compared to that of the nut drive portion 110 of the apparatus of FIGS. 1 to 4, thereby enabling a standard rock bolt installation spanner socket to be utilised.

The nut drive portion 210 has a blind threaded aperture receiving the rock bolt second end 1*b*, thereby providing a closed end face on the drive portion. This thus prevents the rock bolt second end 1*b* from extending beyond the end of the nut 204 and damaging the plastic cap 230. Alternatively, the nut drive portion 210 may be provided with a through aperture in the same manner as the nut 104 of FIGS. 1 to 4, with the rock bolt being provided with a thread of a limited length equal to or shorter than the length of the nut drive portion 210 such that the rock bolt cannot be threaded into the aperture sufficiently for the rock bolt second end 1*b* to protrude beyond the nut.

Figure 13:
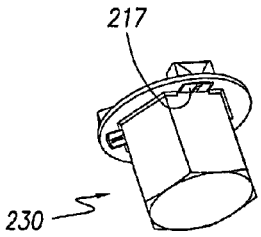
FIG. 13 is a perspective view of an alternate plastic cap.

Referring to FIG. 13, the cap 230 may be provided with seal means in the form of flaps 217 covering the apertures 233. These flaps 217 are biased to the closed position as depicted in FIG. 13, but upon injection of grout the flaps 217 are deflected upwardly to an open position allowing grout to enter the grout passages 212. These flaps 217 accordingly replace the flaps 117 of the apparatus of FIGS. 1 to 4. These flaps 217 also act to provide extra corrosion protection, however they may not be necessary to prevent the escape of grout where a high viscosity grout is utilised.

Figure 14:
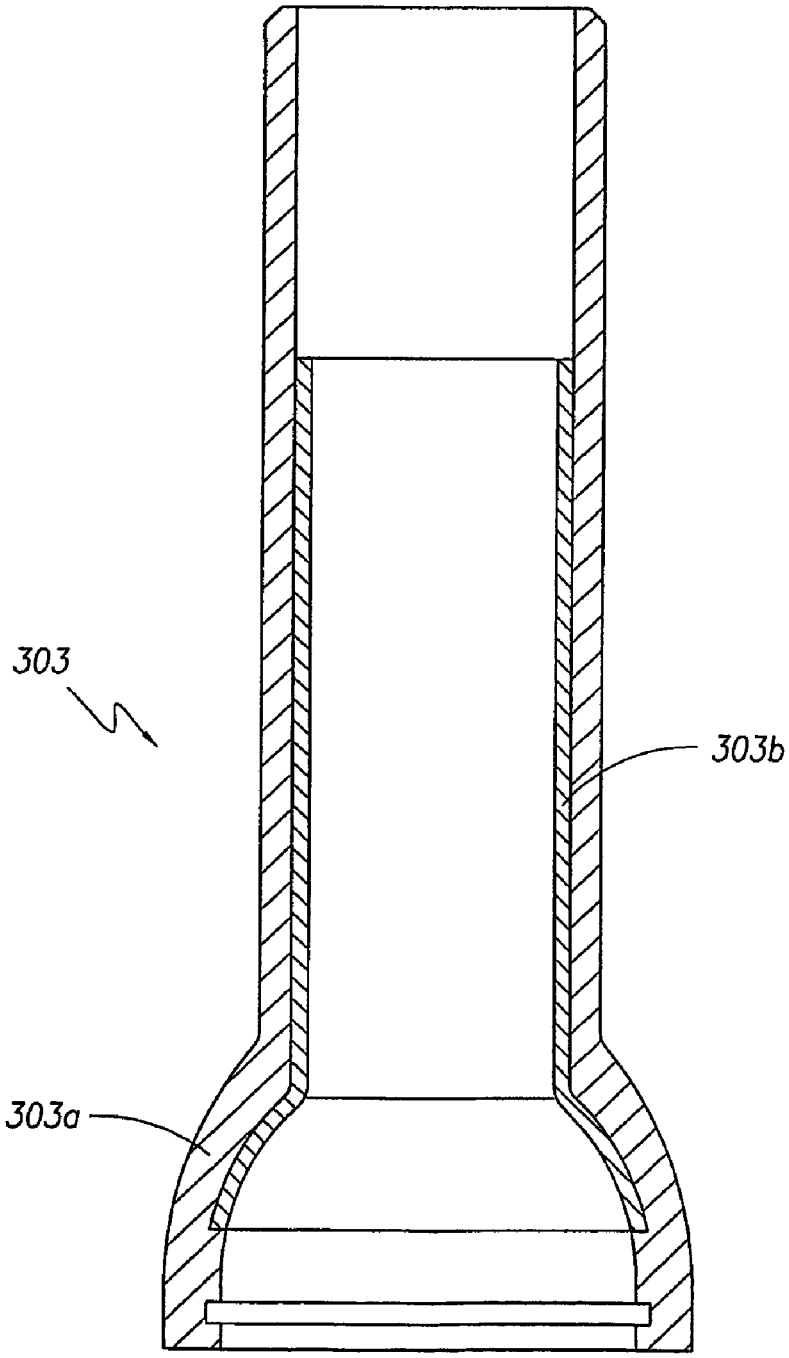
FIG. 14 is a cross sectional front elevation view of a further end fitting female component.

To further improve the corrosion resistance of the end fitting 202, the cap 203 may be formed of a stiff plastics material. In order to increase the strength of the annular flange 204, longitudinally extending stiffening ribs 205*a* have been utilised which act to stiffen the flange 205 while still providing a passage for grout to flow between the flange 205 and the wall of the rock bolt hole 5. In applications where the use of a plastic cup 203 does not provide sufficient strength, a composite cup 303 as depicted in FIG. 14 may be utilised, including a plastic outer skin 303*a* and steel liner 303*b* providing the required strength. Alternatively, the cup 203 might be formed of stainless steel, providing strength and corrosion resistance.

Figure 15:
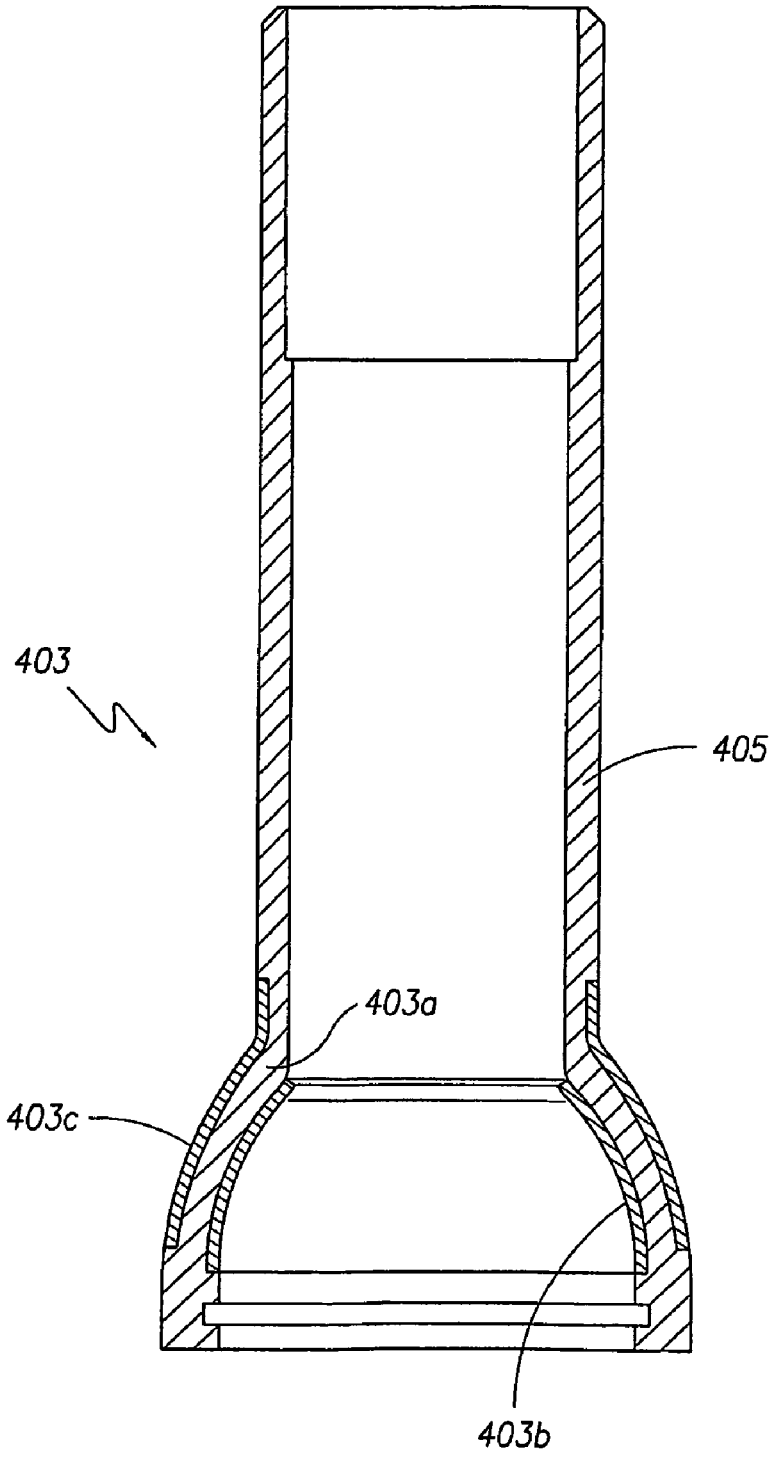
FIG. 15 is a cross sectional front elevation view of a yet further end fitting female component.

A further alternative composite cup-like female component 403 is depicted in FIG. 15. Composite cup 403 includes a plastic main body 403*a* incorporating a plastic flange 405 to which the sleeve 101 is fixed. A carbon steel inner liner/shroud 403*b* is provided in the concavity of the cup-like component 403. The associated male nut-like component 104/204, which will also be typically be formed of carbon steel, engages this inner shroud 403*b* in use. The shroud 403*b* hence effectively acts as a wear lining preventing damage to the plastic main body 403*a* from the male nut-like component 104/204. A stainless steel outer shroud 403*c* is provided on the exterior face of the cup-like component in the region intersecting the cup-like end of the component and the flange 405, and extending along the cup-like end. This stainless steel outer shroud 403*c* will bear against the roof plate 3 in use, again preventing wear of the plastic main body 403*a*. Forming the outer shroud 403*c* from stainless steel will inhibit corrosion of the same.

Whilst the above has been described in relation to a rigid steel bar rock bolt, the post-grouting apparatus is also applicable for use with cable bolt type rock bolts. For cable bolt installations using a threaded cable and nut to tension the cable bolt, the modified nut described above can be utilised in place of the standard tensioning nut. For cable bolt installations during a barrel and wedge assembly to tension the cable, the male component of the end fitting would be formed as a modified barrel, rather than a nut, to replace the standard barrel of the barrel and wedge assembly.

Persons skilled in the art will appreciate other possible modifications to the apparatus described.

The invention claimed is:

1. An apparatus for post-grouting a rock bolt comprising:

an elongate sleeve having first and second ends and being adapted to receive a rock bolt with a first end thereof extending beyond said sleeve first end and a second end thereof extending beyond said sleeve second end;

an end fitting attached to said sleeve second end, said end fitting having a central aperture for receiving said rock bolt and one or more group passages communicating the exterior of said end fitting with the interior of said sleeve; and seal means for sealing said one or more said group passages, said seal means being displaceable between open and closed positions;

wherein said seal means is biased towards said closed position at which said one or more passages is/are substantially sealed and injection of grout into said end fitting via said passage(s) deflects said seal means to said open position enabling flow of grout through said one or more passages and into said sleeve; and wherein said end fitting comprises:

a female component secured to said sleeve second end and defining a concavity facing away from said sleeve, and a male component adapted to be threaded onto said rock bolt second end and to be received within said female component concavity so as to transfer compressive loads between said male and female components, wherein said one or more grout passages is/are defined between said male and female components and said male component is provided with a nut drive surface for threading said male component onto said rock bolt second end to tension said rock bolt.

2. The apparatus of claim 1 wherein said female component concavity is semi-spherical and said male component is provided with a generally complementary convex semi-spherical peripheral surface.

3. The apparatus of claim 1 wherein said female component is provided with coupling means on a peripheral surface thereof for coupling to a grout delivery hose coupling.

4. The apparatus of claim 1 wherein a plurality of said passages are defined as recesses in the peripheral surface of said male component.

5. The apparatus of claim 4 wherein said seal means comprises a flap associated with each of said grout passages.

6. The apparatus of claim 5 wherein said flaps are formed of a resilient plastics material.

7. The apparatus of claim 6, wherein said seal means further comprises a ring-like member extending about said male component with said flap(s) being integrally formed with said ring-like member.

8. The apparatus of claim 1 further including a plastic cap at least substantially covering said end fitting male component.

9. The apparatus of claim 8 wherein said plastic cap incorporates said seal means.

10. The apparatus of claim 8 wherein a peripheral edge of said cap is adapted to engage a groove provided in said end fitting female component concavity to thereby retain the assembly of said plastic cap, said end fitting male component and said end fitting female component.

11. The apparatus of claim 1 wherein said apparatus is provided with a tapered cap at said sleeve first end, said tapered cap being provided with a central open passage for receipt of said rock bolt and a plurality of apertures in a side wall of said cap for passage of grout therethrough.

12. The apparatus of claim 1 wherein said female component is formed of stainless steel.

13. A rock bolt assembly comprising:

an apparatus according to claim 1, including:

a rock bolt having first and second ends, said rock bolt being received by said elongate sleeve with said rock bolt first and extending beyond said sleeve first end and said rock bolt second end extending beyond said sleeve second end, said rock bolt further being received by said end fitting central aperture.

14. An apparatus for post-grouting a rock bolt comprising:

an elongate sleeve having first and second ends and being adapted to receive a rock bolt with a first end thereof extending beyond said sleeve first end and a second end thereof extending beyond said sleeve second end;

an end fitting attached to said sleeve second end, said end fitting having a central aperture for receiving said rock bolt and one or more grout passages communicating the exterior of said end fitting with the interior of said sleeve;

a coupling member having first and second ends and an internal cavity opening onto said coupling member first end, said coupling member first end being adapted to be coupled to said end fitting with said coupling member cavity communicating with said one or more grout passages, said coupling member being provided with an inlet port adapted to be coupled to a grout delivery hose and a valve means for sealing said inlet port, wherein said coupling member is adapted to enclose said rock bolt second end within said coupling member cavity.

15. The apparatus of claim 14 wherein said coupling member is formed of a plastics material.

16. The apparatus of claim 14 wherein said end fitting comprises:

a female component secured to said sleeve second end and defining a concavity facing away from said sleeve, and a male component adapted to be threaded onto said rock bolt second end and to be received with said female component concavity and engage the wall thereof, wherein said one or more grout passages is/are defined at the interface between said male and female components and said make component is provided with a nut drive surface for threading said male component onto said rock bolt second end to tension said rock bolt.

17. The apparatus of claim 16 wherein said female component concavity is semi-spherical and said male component is provided with a mating convex semi-spherical peripheral surface for engaging said semi-spherical concavity.

18. A rock bolt assembly comprising:

an apparatus according to claim 14, including:

a rock bolt having first and second ends, said rock bolt being received by said elongate sleeve with said rock bolt first end extending beyond said sleeve first end and said rock bolt second end extending beyond said sleeve second end, said rock bolt further being received by said end fitting central aperture.

19. An apparatus for post-grouting a rock bolt comprising:

an elongate sleeve having first and second ends and being adapted to receive a rock bolt with a first end thereof extending beyond said sleeve first end and a second end thereof extending beyond said sleeve second end; and an end fitting attached to said sleeve second end and having a central aperture for receiving said rock bolt, said end fitting comprising:

a female component secured to said sleeve second end and defining a concavity facing away from said sleeve, and a male component adapted to be threaded onto said rock bolt second end and to be received within said female component concavity and engage the wall thereof, wherein one or more grout passages communicating the exterior of said end fitting with the interior of said sleeve are defined at the interface between said male and female components and said male component is provided with a nut drive surface for threading said male component onto said rock bolt second end to tension said rock bolt, further wherein a plastic cap at least substantially covers said end fitting male component, a peripheral edge of said cap being adapted to engage a groove provided in said end fitting female component concavity to thereby retain the assembly of said plastic cap, said end fitting male component and said end fitting female component.

20. The apparatus of claim 19 wherein said plastic cap incorporates a seal means for sealing said one or more grout passages, said seal means being displaceable between open and closed positions and being biased towards said closed position at which said one or more passages is/are substantially sealed and injection of grout into said end fitting via said passage(s) deflects said seal means to said open position enabling flow of grout through said one or more passages and into said sleeve.

21. The apparatus of claim 19 wherein said male component has a blind threaded aperture for threadingly receiving said rock bolt second end.

22. The apparatus of claim 19 wherein said male component has a threaded aperture extending through the length thereof for threadingly receiving said rock bolt second end, said threaded aperture and/or said rock bolt being configured to prevent said rock bolt second end extending beyond said threaded aperture.

23. A rock bolt assembly comprising:

an apparatus according to claim 19, including:

a rock bolt having first and second ends, said rock bolt being received by said elongate sleeve with said rock bolt first end extending beyond said sleeve first end and said rock bolt second end extending beyond said sleeve second end, said rock bolt further being received by said end fitting central aperture.

* * * * *